US005152513A

United States Patent [19]

Ogasawara et al.

[11] Patent Number: 5,152,513

[45] Date of Patent: Oct. 6, 1992

[54] SHEET REVERSING APPARATUS FOR INDIVIDUAL SHEET FEEDING

[75] Inventors: Tsuyoshi Ogasawara, Ibaraki; Junichi Matsuno, Toride; Masataka Kawauchi, Ishioka; Makoto Kurosawa; Masaaki Koseki, both of Katsuta; Tetsuro Takahashi, Mito; Youichi Takeuchi, Katsuta, all of Japan

[73] Assignees: Hitachi, Ltd.; Hitachi Kiki Co., Ltd., both of Tokyo, Japan

[21] Appl. No.: 548,630

[22] Filed: Jul. 5, 1990

[30] Foreign Application Priority Data

Jul. 5, 1989 [JP] Japan ..... 1-173597

[51] Int. Cl.[5] ..... B65H 5/22

[52] U.S. Cl. ..... 271/3.1; 271/5; 271/184; 271/220; 271/223; 271/227; 271/245; 271/254; 271/902

[58] Field of Search ..... 271/3.1, 176, 177, 180, 271/182, 213, 220, 221, 223, 224, 902, 227, 229, 245, 5, 6, 12, 94, 99, 104, 253, 254, 184

[56] References Cited

U.S. PATENT DOCUMENTS

| | | | |
|---|---|---|---|
| 4,214,740 | 7/1980 | Acquaviva . | |
| 4,275,877 | 6/1981 | Silverberg . | |
| 4,456,237 | 6/1984 | Buddendeck | 271/3.1 |
| 4,469,319 | 9/1984 | Robb et al. | 271/223 |
| 4,650,176 | 3/1987 | Sugizaki et al. . | |
| 4,660,824 | 4/1987 | Hermkens et al. | 271/182 X |
| 4,869,488 | 9/1989 | Hirota et al. | 271/3.1 |
| 4,923,190 | 5/1990 | Hirose | 271/902 X |

FOREIGN PATENT DOCUMENTS

| | | | |
|---|---|---|---|
| 3228570 | 2/1983 | Fed. Rep. of Germany . | |
| 3731466 | 4/1988 | Fed. Rep. of Germany . | |
| 2122976 | 1/1984 | United Kingdom | 271/182 |

OTHER PUBLICATIONS

Ernst, Copier Skew Reduction, Nov. 1980, IBM Tech. Disclosure Bulletin, vol. 23, No. 6, p. 2217.

*Primary Examiner*—Robert P. Olszewski
*Assistant Examiner*—Boris Milef
*Attorney, Agent, or Firm*—Antonelli, Terry, Stout & Kraus

[57] ABSTRACT

A sheet reversing apparatus comprises a support in which sheets are stacked, an entrance section for guiding the sheet to the support, a blowing mechanism for directing an air stream to a sheet stack on the support to separate a lowermost sheet from remaining sheets, and a feeding mechanism for attracting the sheet to feed it. Further, stopper plates are provided to be pivoted above the support so that it cooperates with the support to pinch and brake the sheet therebetween in a continuous reversing mode wherein the incoming sheet is immediately fed and that it abuts against the incoming sheet by a portion thereof opposing a leading end of the sheet in a stack reversing mode wherein while the sheets are being stacked the lowermost sheet is separated and fed.

9 Claims, 12 Drawing Sheets

SHEET REVERSING APPARATUS FOR INDIVIDUAL SHEET FEEDING

BACKGROUND OF THE INVENTION

The present invention relates to a sheet reversing apparatus which can positively register sheets being fed and feed the sheets one by one. The sheet reversing apparatus is applicable to a laser beam printer for performing the recording or printing on both surfaces of the sheet, but is not limited to such application.

In printing machines such as a laser beam printer and the like, when the both-surface recording is effected, first of all, a first surface of a sheet is printed. Then, the sheet is fed, with the printed first surface turned over by a sheet reversing apparatus, from the sheet reversing apparatus to a printing station again, and a second surface of the sheet is printed at the printing station.

Conventional reversing apparatuses were divided into generally two types, in one of which the incoming sheet was continuously fed out as it was, and in the other of which a plurality of sheets were once stacked and thereafter the sheet was separated and fed one by one from the bottom of the sheet stack. Accordingly, in the past, there was no sheet reversing apparatus wherein the receipt of a next sheet and the feeding-out the previously received sheet were simultaneously and continuously effected while a plurality of sheets were stacked.

In the conventional reversing apparatus of the former type, for example, a continuously rotating rubber impeller is used as a sheet hold-down means, and a regulating means such as a stopper is also provided to cooperate with the hold-down means. The sheet is registered by these means and is continuously received by the reversing apparatus to be fed out as it is.

In the conventional reversing apparatus of the latter type, a stopper means is movably arranged in the vicinity of the stacking station, which stopper means serves to register and stack the sheets during the stacking operation. On the other hand, during the sheet separating and feeding operation, the stopper means is separated from the sheet stack to release the urging force of the stopper means acting on the sheet stack, thereby preventing the double-feeding of the sheets. Further, as disclosed in the U.S. Pat. No. 4,275,877, in a sheet reversing apparatus wherein the sheet separating and feeding operation is effected by using a vacuum suction, the whole stacking station is inclined downwardly with respect to a horizontal plane, and a rear guide is provided at the stacking station. In addition, an air blowing portion is arranged in confronting relation to the stacking station, and a feeding portion is disposed below the stacking station. Sheets fed to the stacking station are abutted against the rear guide to be registered and are successively stacked. Thereafter, by intermittently activating the air blowing portion and the feeding portion, an lowermost sheet in the sheet stack is attracted by the vacuum suction force, whereas the remaining sheets are floated to separate from the lowermost sheet, thereby preventing the multifeeds of the sheets.

However, the arrangement in the reversing apparatus of the former type arose a problem when it was used with a high speed printer. That is to say, in the high speed printer, it is necessary to previously convert the printing information into dots and store them in a memory. Thus, in order to continuously reverse the sheets, the memory means therefor becomes large-sized as that used in a large-sized computer, which leads in the increase in the cost of the whole printer.

On the other hand, in the conventional reversing apparatus of the latter type in which the sheets are separated and fed after they have previously been stacked, it is difficult to control the air system for separating the sheet from the bottom of the sheet stack and attracting the sheet intermittently at a high speed. Consequently, there arose a problem that it was impossible to reverse and feed the sheet at a high speed.

SUMMARY OF THE INVENTION

An object of the present invention is to provide a sheet reversing apparatus which can receive and feed sheets from time to time with a simple construction even if the sheets are stacked.

Another object of the present invention is to provide a sheet reversing apparatus wherein, even when the incoming sheets are continuously fed as they are or when the sheets are temporarily stacked, the sheet can be registered and fed positively.

According to the present invention, a sheet reversing apparatus comprises a support means on which sheets are stacked, a hold-down guide means for guiding a sheet being fed toward the support means, a stopper means for stopping the sheet to position it on the support means in place, a feeding means for attracting a lowermost sheet in a sheet stack on the support means to feed it, and a blowing means for directing an air stream toward a bottom of the sheet stack on the support means to separate the lowermost sheet from the remaining sheets. The stopper means is pivotable so as to extend into and retract from a sheet feeding path to the support means so that the stopper means can abut against the incoming sheet at different positions in accordance with a continuous reversing mode wherein the incoming sheet is immediately fed and a stack reversing mode wherein while the sheets are being stacked the lowermost sheet is separated and fed.

Preferably, the stopper means can intersect with the support means to brake and position the sheet by using a gap formed therebetween when the continuous reversing mode is used, and brakes the sheet by abutting against a leading edge of the sheet when the stack reversing mode is used.

A first sensor for detecting the arrival of the sheet and a second sensor for detecting the sheet stacked on the support means may be provided, and the stopper means may be actuated on the basis of commands signals of the first and second sensors and a signal commanding the initiation of the feeding of the sheet.

It is preferable that a size of the sheet is determined on the basis of the signal from the first sensor and the stopper means intersects with the support means at an single according to the sheet size.

Further, preferably, the hold-down guide means may include two hold-down guides arranged in parallel along the support means and disposed on both sides of the support means adjacent thereto, and regulates the sheet (on the support means) floated by the air stream.

Further, it is preferable that the support means is inclined downwardly at a front portion thereof with respect to a sheet feeding direction to reduce a friction resistance to the sheet.

With the arrangement mentioned above, in the continuous reversing mode wherein only a single sheet is situated on the support means at all times, the stopper means can hold the incoming sheet down to positively brake and position the sheet. On the other hand, in the stack reversing mode, the stopper means can abut against the incoming sheet at the different position to brake the sheet without pressing the stacked sheets. Consequently, even in the stack reversing mode, it is possible to prevent the double-feeding of the sheets while braking the incoming sheet positively and to receive and feed the sheet from time to time.

Further, according to the preferred aspect mentioned above, when the incoming sheets are reversed at any time, the sheet is pinched by the gap formed by intersecting the stopper means with the support means. On the other hand, in the stack reversing mode wherein while a plurality of sheets are stacked the stacking operation and the reversing operation are continuously performed, the stopper means crossed with the support means in response to the signals from the sensors is shifted upwardly at a predetermined angle to regulate a stop position of the sheet at a portion of the stopper means opposing the leading end of the sheet.

In this way, in the continuous reversing mode, since the inertia force of the incoming sheet is absorbed by pinching the sheet by the gap between the stopper means and the support means, the bounce of the sheet due to the impingement of the sheet in a longitudinal direction or sheet feeding direction is eliminated, thereby stacking the sheets with high accuracy. Further, in the stack reversing mode, since the stopper means is shifted upwardly, a friction resistance or feeding resistance between the sheets is eliminated by the air stream, thereby preventing non-feeding and/or double-feeding of the sheets.

In addition, by providing two parallel hold-down guides in the vicinity of the support means, in the continuous reversing mode, these hold-down guides hold both ends of the sheet on the support means. Thus, it is possible to prevent the raising of the central portion of the sheet when the sheet is attracted by suction, and to prevent the poor attraction of the sheet due to a curl of the sheet caused by a change in the surrounding conditions, thereby feeding the sheet positively. On the other hand, in the sheet stacking operation, the position of the leading end of the sheet is not varied by the thickness of the sheet, thus improving the stacking accuracy. Further, since the guides hold both ends of the remaining sheets floated by the air stream, the rigidity of the sheets is increased, whereby the air layer between the lowermost sheet and the remaining sheets can extend to prevent the double-feeding of the sheets positively.

DETAILED DESCRIPTION OF THE PREFERRED EMBODIMENTS

Figure 1:
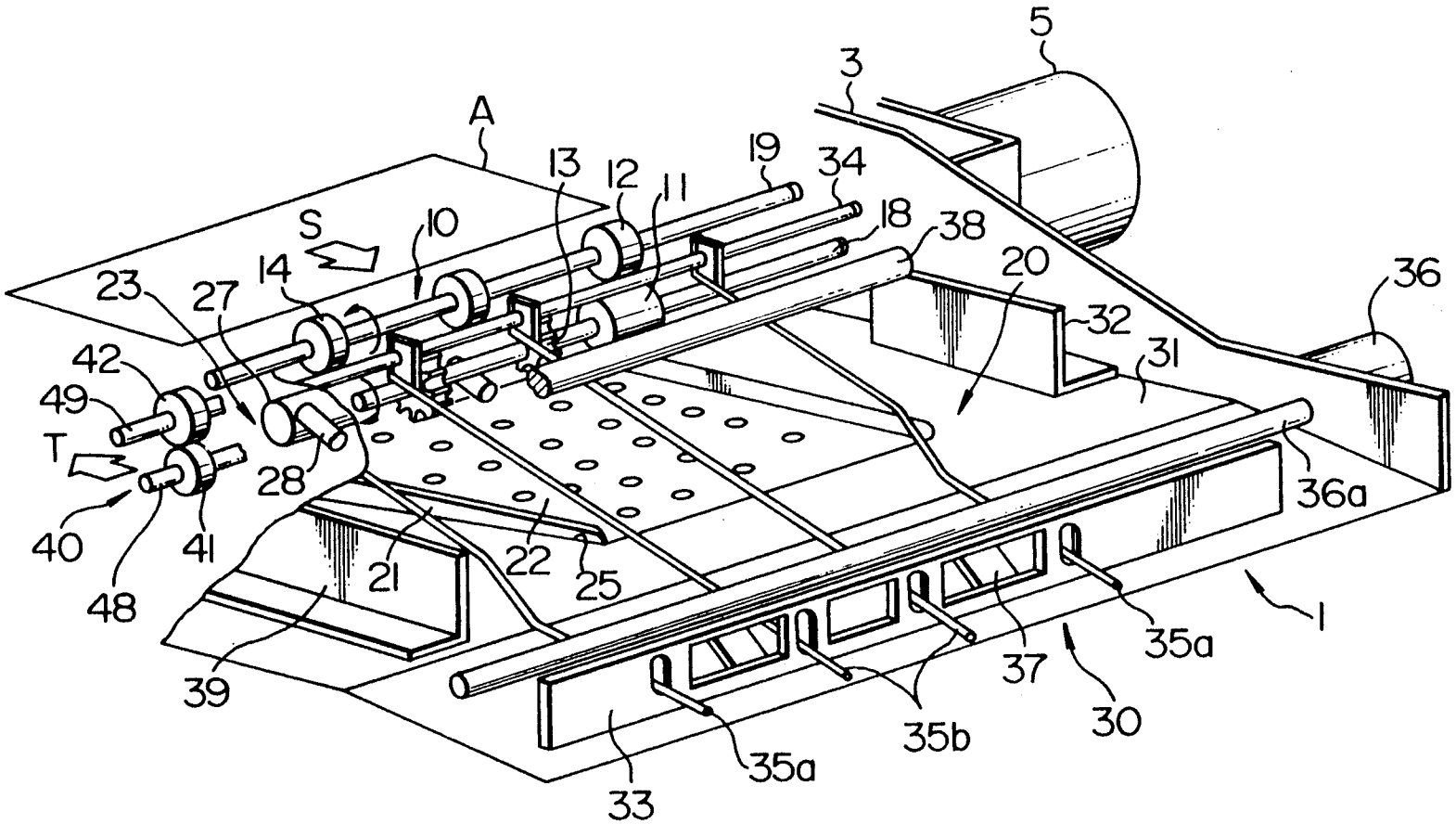
FIG. 1 is a perspective view of a main portion of a sheet reversing apparatus according to a first embodiment of the present invention.
Figure 2:
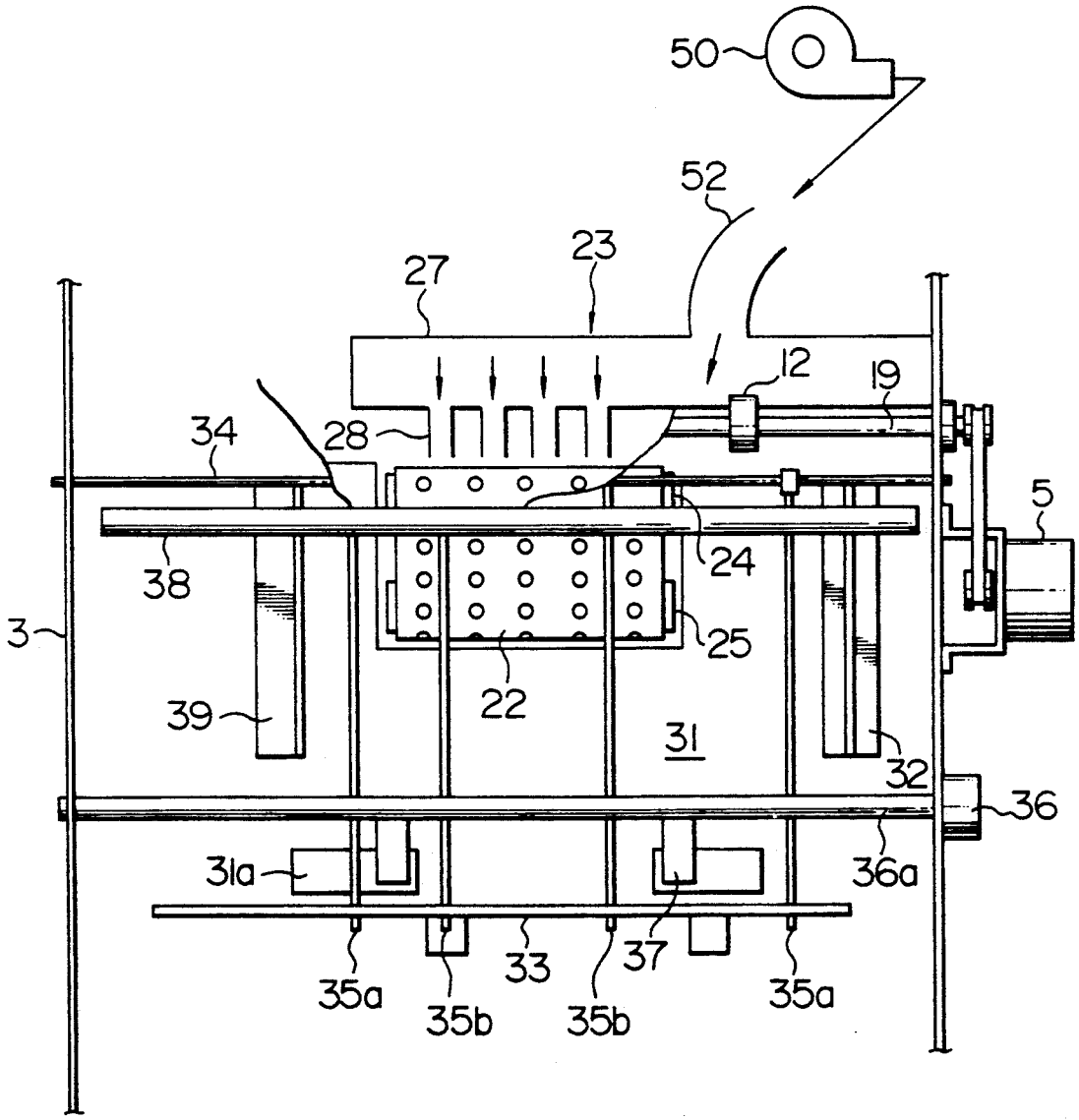
FIG. 2 is a plan view of the apparatus shown in FIG. 1.

The present invention will now be explained in connection with embodiments thereof with reference to the accompanying drawings. With reference to FIGS. 1 and 2, the sheet reversing apparatus 1 of the present invention is provided with an entrance section 10, a feeding section 20, a stacking section 30 and an ejecting section 40, and an incoming sheet moves through these sections.

Figure 3:
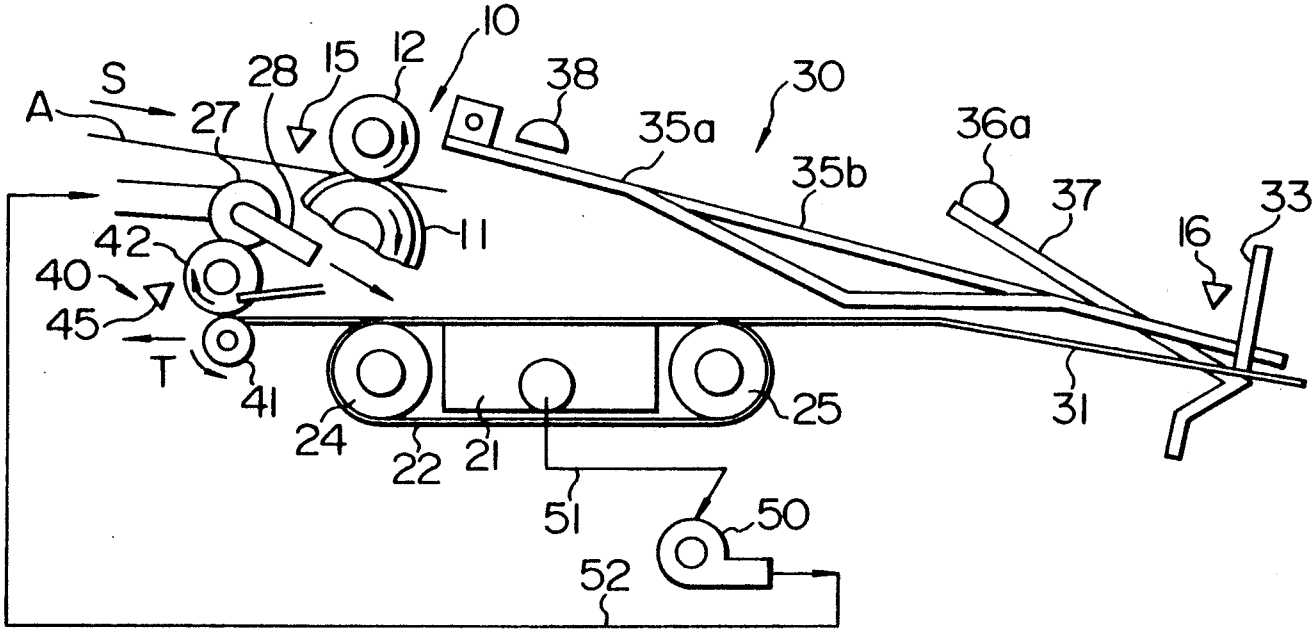
FIGS. 3 and 4 are side view for explaining a stacking operation of the apparatus of FIG. 1 in a continuous reversing mode.

The entrance section 10 includes lower pulleys 11 and lower rollers 13 which are mounted on a lower pulley shaft 18, upper pulleys 12 and upper rollers 14 which are mounted on an upper pulley shaft 19, and a sheet detector or sensor 15 (FIG. 3). Each lower roller 13 has a plurality of projections on its outer peripheral surface.

The lower and upper pulley shafts 18 and 19 are supported by a frame 3 in confronting relation to each other, and the lower pulley shaft 18 is rotated in a sheet feeding direction shown by the arrow S by means of a driving motor 5. On the other hand, the upper pulley shaft 19 is so supported that it can be slightly shifted upwardly and downwardly.

The lower pulleys 11 are two (only one of which is illustrated in the drawing) and are disposed on the lower pulley shaft 18 at a predetermined distance. The plurality of lower rollers 13 are arranged between two lower pulleys 11. Each lower roller 13 has a diameter larger than those of the lower pulleys.

The upper pulleys 12 are arranged to be opposed to and contact the corresponding lower pulleys 11. Each upper roller 14 is disposed between the adjacent lower rollers 13 to stagger with the latter and has a diameter equal to or smaller than those of the upper pulleys 12.

With this arrangement, the staggered lower and upper rollers 13 and 14 can flex a sheet in a wave form to increase the rigidity of the sheet. Thus, the sheet can be fed straightly to the stacking section 30 without depending downwardly at a leading portion thereof. The sensor 15 is arranged in the vicinity of a contacting area between the lower and upper pulleys 11 and 12 to detect the passage of the sheet through the entrance section 10.

The sheet feeding section 20 is provided with a vacuum chamber 21, a suction belt 22 and a blowing mechanism 23. The vacuum chamber 21 comprises an enclosed box having a plurality holes formed in an upper surface thereof, and is attached to a lower portion of the frame 3 in such a manner that the upper surface of the box is flush with a bottom plate 31 of the stacking section 30, described more fully hereinbelow, an shown in FIG. 3. The suction belt 22 comprises an endless belt wound around a pair of pulleys 24, 25 on both sides of the vacuum chamber 21 to surround the chamber 21. The pulleys 24, 25 are rotatably mounted on a bottom frame (not shown) of the apparatus, and are rotated in a sheet feeding direction shown by the arrow T by means of a driving motor (not shown). The suction belt 22 has a plurality of holes adapted to be communicated with the holes of the vacuum chamber 21.

The blowing mechanism 23 is mounted on the frame 3, and comprises a blower 50 and a blow-out portion 27, as shown in FIG. 3. To the blower 50, a suction tube 51 for drawing the air in the vacuum chamber 21 and a discharge tube 52 for discharging the drawn air are connected. The blow-out portion 27 is attached to the entrance section 10 adjacent and below the pulley shafts 18, 19 and is connected to the blower 50 through the discharge tube 52. Further, the blow-out portion 27 has a plurality of discharge ports 28 directing toward the stacking section 30. Accordingly, when the blower 50 is activated, the air drawn from the vacuum chamber 21 is sent to the blow-out portion 27, and is discharged from the discharge ports 28 toward a lowermost sheet of a sheet stack in the stacking section 30. If the sheets are stacked on the stacking section 30, the stacked sheets A are floated above from the suction belt 22.

Incidentally, in an blow-out portion 27, the discharge tube 52 is attached to the end of the blow-out portion, and a air stream discharged from each discharge port 28 has the faster speed as the distance between the discharge port and the discharge tube 52 is longer. Thus, the sheet or sheets A in the stacking section 30 are shifted laterally upon being floated, whereby the sheet or sheets are properly positioned by being abutted against a side plate 32, described more fully hereinbelow.

The stacking section 30 is disposed adjacent to the entrance section 10, and includes a bottom plate 31 serving as a support means for the sheets, a sensor 16 (FIG. 3) for detecting the stacking of the sheets A, a guide means 35 for preventing the floating of the sheets, and a plurality of stopper plates 37 for regulating the stop position of the sheet A. The bottom plate 31 is fixed to the frame 3, and is inclined downwardly at its rear portion as shown in FIG. 3, and further has a notch or cutout at its front portion to expose the suction belt 22. To the bottom plate 31, a pair of side plates 32 and 39 are attached on both sides of the botch, and a rear plate 33 is also attached at the rear portion thereof. The side plates 32 and 39 act as sides guide for the sheet A, and the side plate 39 can be shifted laterally in accordance with the size of the sheet.

The guide means 35 includes a plurality of guide rods 35*a*, 35*b* which are spaced apart from each other and disposed above the bottom plate 31. Each of the guide rods 35*a*, 35*b* is fixed to a shaft 34 at its one end, and the shaft 34 is rotatably supported by the frame 3 in the vicinity of the pulley shafts 18, 19. Further, the other end of each guide rod is inserted into a corresponding slot formed in the rear plate 33. Thus, the guide means 35 can be pivoted about the shaft 34 in a limited range defined by the slots formed in the rear plate 33 not vary the distance between the guide means 35 and the bottom plate 31 largely. The guide rods 35*a* positioned on both sides of the guide means 35 have configurations different from those of inner guide rods 35*b* and are bent toward the bottom plate 31 at their central portions.

On the other hand, plates 37 acting as a stopper means are spaced apart from each other and are arranged above the bottom plate 31 in the vicinity of the rear plate 33. Each plate 37 is attached to a shaft 36*a* at its one end. The shaft 36*a* is rotatably mounted on the frame 3 and is connected to a driving motor 36. Further, the other end of each plate 37 is bent downwardly to be inserted into a corresponding notch 31*a* (FIG. 2) formed in the bottom plate 31. Thus, the stopper plates 37 can be pivoted upwardly and downwardly by means of the driving motor 36 in a limited range defined by the notches 31*a*.

Incidentally, a discharger 38 for removing the electrostatic charge carried by the incoming sheet A is arranged in the vicinity of the entrance section 10 above the guide means 35.

The ejecting section 40 is disposed adjacent to the bottom plate 31 of the stacking section 30 and below the blow-out portion 27 of the feeding section 20, and includes two sets of paired upper and lower ejector pulleys 42 and 41 contacting each other, and upper and lower pulley shafts 49 and 48 on which the ejector pulleys 41 and 42 are respectively mounted. The shafts 48 and 49 are rotatably mounted on the frame 3, and the upper pulley shaft 49 is connected to the driving motor 5 like the lower pulley shaft 18 in the entrance section 10, to be rotated in a direction shown by the arrow T. Further, the lower ejector pulley shaft 48 can be shifted slightly for up-and-down movement like the upper pulley shaft 19 in the entrance section 10. A sensor 45 (FIG. 3) for detecting the ejection of the sheet is arranged in the vicinity of the contacting area between the ejector pulleys 41 and 42.

Next, an operation of the sheet reversing apparatus 1 according to the above-mentioned first embodiment will be explained with reference to FIGS. 3 to 6. The sheet reversing apparatus are operated in the following two modes in order to improve the operability thereof and to reduce the cost thereof by making the memory means of the printer small-sized, as mentioned above.

(1) A Continuous Reversing Mode

Figure 4:
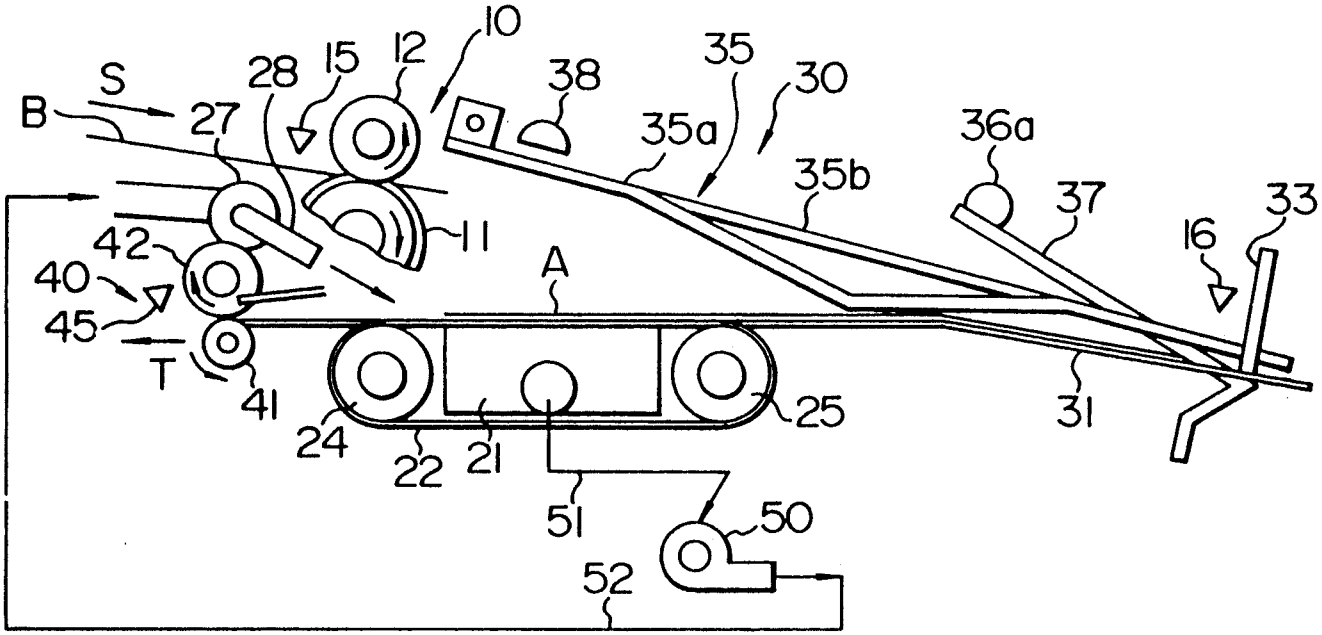

In this mode, as shown in FIGS. 3 and 4, the incoming sheet is fed as it is to the ejecting section 40.

(2) A Stack Reversing Mode

Figure 5:
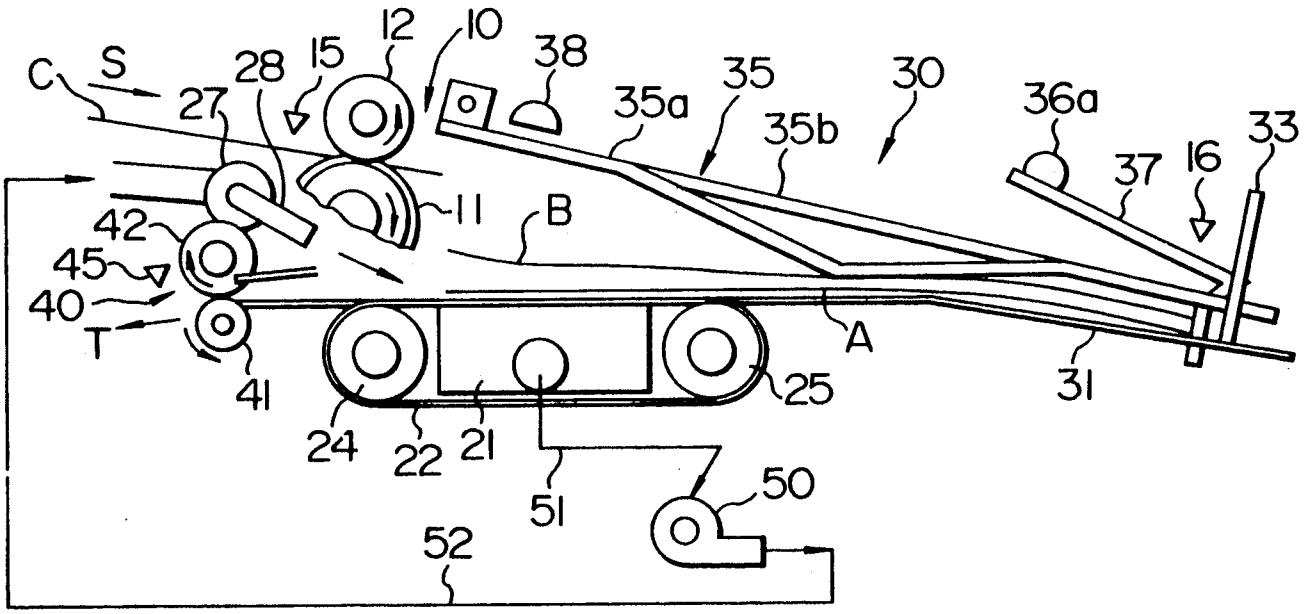
FIGS. 5 and 6 are side views for explaining a stacking operation of the apparatus of FIG. 1 in a stack reversing mode.
Figure 6:
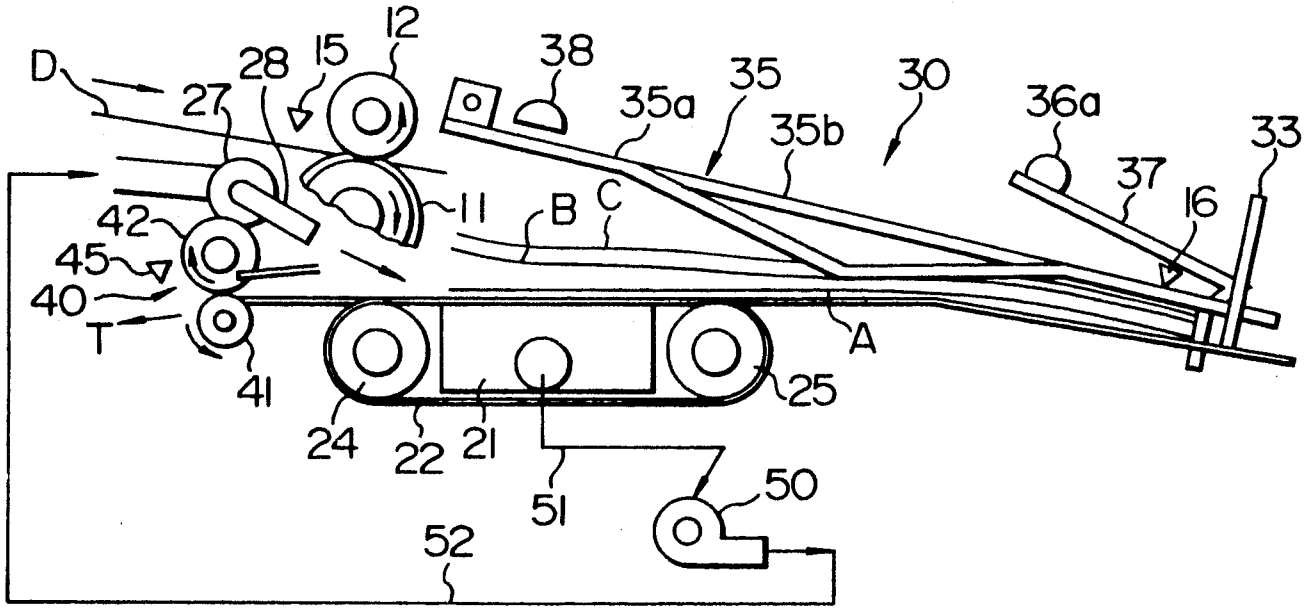

This mode is used when the speed of conversion of the printing information into dots is slower than the speed of the incoming sheet, i.e., when the receiving ratio for sheets is larger than the sheet feeding-out ratio dependent upon the printing condition of the associated printer. As shown in FIGS. 5 and 6, while the sheets A and B still remains on the stacking section 30, a further sheet C is stacked through the sheet feeding path. At the same time, in response to the conversion of the printing information into the dots, the sheet is fed to the ejecting section 40 successively from the sheet A to the sheet C.

First of all, the continuous reversing mode will be explained.

The sheet A fed in the direction S from the sheet feeding path (not shown) connected to the printer is pinched by the pulleys 11 and 12 (in the entrance section 10) rotated by the driving motor 5, and is fed straightly to the stacking section 30 by the feeding force of the pulleys 11, 12. In this case, the blower 50 is activated, with the result that the air is supplied to the blow-out portion 27 through the discharge tube 52 and is discharged from the plurality of discharge portion 28 as air streams of different speeds. Further, by the suction force of the blower 50, the negative pressure is created in the vacuum chamber 21.

The fed sheet A is detected by the sensor 15 in the entrance section 10 and by the sensor 16 in the stacking section 30. Each sensor 15 or 16 emits a detection signal so long as the sheet remains in a detection position therefor. On the other hand, the associated printer emits a reversing signal commanding the initiation of the feeding of the sheet. The signals from the sensors 15, 16 are compared on the basis of the reversing signal, whereby the receipt and feeding of the sheet in accordance with the printing condition is determined. This comparison is performed by judging whether the signals from the sensors 15, 16 coincide with each other or not when a predetermined set time $t_1$ from the generation of the reversing signal is elapsed after the sheet has been detected by the sensors 15, 16. On the basis of the comparison result, the position of the stopper plates 37 shifted by the motor 36 is determined.

Figure 7:
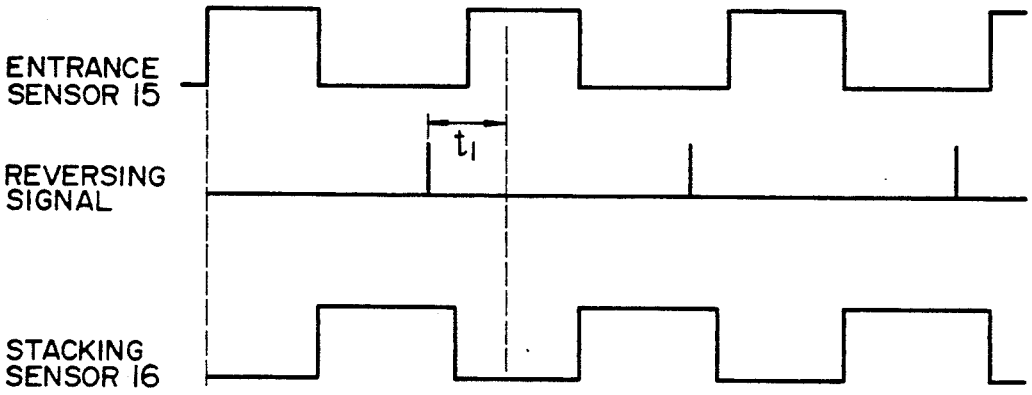
FIG. 7 is a timing chart in the continuous reversing mode of the apparatus of FIG. 1.

As shown in FIG. 7, if the signals from the sensors 15, 16 do not coincide after the set time $t_1$ has been elapsed, it means that the previous sheet has already been fed out and does not remain in the apparatus when the next sheet A is received. In this case, the stopper plates 37 are shifted to the lower position as shown in FIG. 3 to be deeply inserted into the notches of the bottom plate 31 thereby intersecting with the bottom plate 31. The sheet A fed to the stacking section 30 is pinched by a gap between the stopper plates 37 and the bottom plate 31, thereby absorbing the kinematic energy of the incoming sheet to stop the sheet. In this way, the sheet reversing apparatus is in the continuous reversing mode.

Consequently, the sheet A is stopped on the bottom plate 31 in place without deviating in the longitudinal direction or in the transverse direction, and then is attracted or sucked by the suction belt 22 enclosing the vacuum chamber 21. In this case, since the outer guide rods 35*a* of the guide means 35 are disposed in the vicinity of the sheet support means, both side edges of the sheet is held by these rods, thus preventing the raising of the central portion of the sheet even if the sheet is thin. Accordingly, regardless of the thickness of the sheet, the sheet is always attracted stably.

After the sheet is attracted, the driving motor (not shown) in the feeding section 20 is activated to rotate the suction belt 22 through the pulley 24, thus feeding the attracted sheet to the ejecting section 40. In this ejecting section, the ejector pulleys 41, 42 are rotated by the activation of the driving motor 5, and, accordingly, the sheet pinched by the ejector pulleys 41, 42 is fed meanwhile, the sheet is detected by the sensor 45 in the ejecting section 40. The driving motor in the feeding section 20 is stopped when the detection signal from the sensor 45 disappears. This motor may be intermittently activated for a predetermined time without using the signal from the sensor 45. Also in this case, the same advantage can be obtained.

As shown in FIG. 4, the sheet is introduced into the entrance section for a predetermined cycle, and the introduction of the next sheet B is detected by the sensor 15. Also regarding the sheet B, as in the case of the sheet A, the position of the stopper plates 37 is determined on the basis of the detection signals from the sensors 15, 16, and the sheet B is also stopped by being pinched by the gap between the stopper plates 37 and the bottom plate 31. By repeating such operations for a predetermined cycle, the stable continuous reversing of the sheets can be achieved.

Next, the stack reversing mode will be explained.

First of all, when the first sheet is introduced, as in the case of the aforementioned continuous reversing mode, the sheet A fed from the sheet feeding path (not shown) is fed to the stacking section 30 by the feeding force at the entrance section 10, and then is stopped by the gap defined between the bottom plate 31 and the stopper plates 37. Thereafter, the sheet is attracted by the suction belt 22. After the sheet is attracted by the suction belt, while in the continuous reversing mode, the driving motor (not shown) in the feeding section 20 is activated to feed the sheet A to the ejecting section 40, in the stack reversing mode, by repeating the above operation again, the sheet B is stacked on the sheet A.

Figure 8:
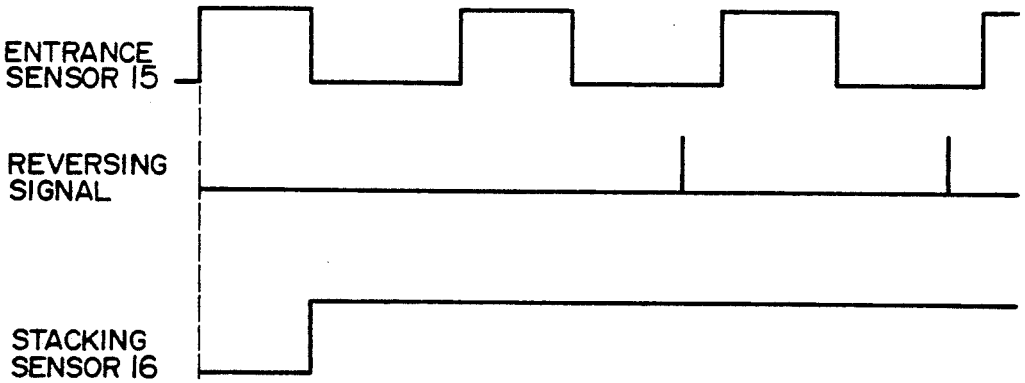
FIG. 8 is a timing chart in the stack reversing mode of the apparatus of FIG. 1.

That is to say, as mentioned with respect to the continuous reversing mode, whenever each sheet is introduced, the signal from the sensor 15 in the entrance section 10 and the signal from the sensor 16 in the stacking section 30 are compared. If the previous sheet A is not fed before the next sheet B is introduced and, as shown in FIG. 8, the signals from the sensors 15, 16 are coincident even after the set time upon the generation of the reversing signal has been elapsed, the stopper plates 37 are shifted by the driving motor 36 for a certain angle to each the upper position as shown in FIG. 5. In this position, each stopper plate 37 is lifted above the guide means 35 although the bent end portion thereof is still inserted into the corresponding notch 31*a* of the bottom plate 31. Consequently, the stopper plates 37 abut against each sheet at a different position differ from the position in the case of the aforementioned continuous reversing mode, i.e., at the bent end portions thereof, thus absorbing the kinematic energy of the sheet. The bounce of the sheet caused by the engagement between the sheet and the stopper plates 37 is suppressed by the guide means 35. In this way, the sheet reversing apparatus is in the stack reversing mode.

Although the firstly stacked sheet A is attracted by the suction belt 22, the next sheet B and the other sheets stacked on the sheet A are floated from the sheet A by the air streams from the discharge ports 28, thus separating from the sheet A. Further, the next and subsequent sheets (remaining sheets) are separated from each other by creating air layers between two adjacent sheets and are registered with each other by the bent end portions of the stopper plates 37 and the side guide plate 32. Now, since the outer guide rods 35*a* of the guide means 35 hold the both side edges of the floating sheet B, the rigidity of the sheet B is increased so as not to be easily flexed, and the air layers created between the sheets increases to a large extent. Further, since the side plates 32, 39 are disposed on both sides of the sheet, the air cannot escape from the sides of the sheet, thus improving the service efficiency of the air stream.

The sheets are successively introduced into the sheet reversing apparatus for a given cycle, and, thus, subsequently to the sheet C, a sheet D is introduced. On the other hand, in response to the reversing signal, the driving motor (not shown) in the feeding section 20 is activated to rotate the suction belt 22 through the pulley 24, thus feeding the attracted lowermost sheet A to the ejecting section 40. In this case, since the sheets B, C, stacked in the stacking section 30, are separated from the sheet A by the air streams from the discharge ports 28 and the electrostatic charge on the sheets has been removed by the discharger 38 when they are introduced into the apparatus, the sheets B, C are not moved together with the sheet A by the feeding force of the sheet A and the electrostatic force between the sheets, and, thus, remain being registered along the stopper plates 37. By repeating such operations for a predetermined cycle to feed the sheets B, C, a stable stack reversing of the sheet can be achieved.

Incidentally, the comparison of the detection signals from the sensors 15, 16 is performed in an operator provided in the associated printer or in the sheet reversing apparatus itself. The operator may be a conventional one, and thus, the explanation thereof will be omitted.

Figure 9:
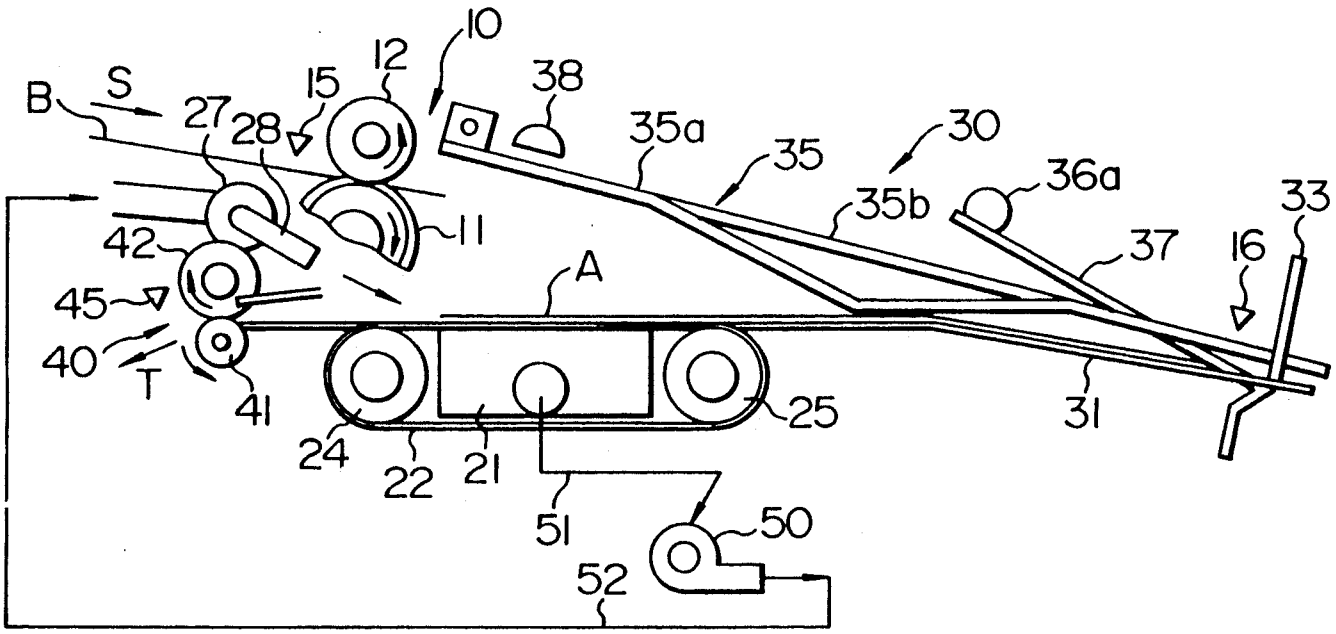
FIG. 9 is a side view for explaining the feeding of a letter-size sheet by the apparatus of FIG. 1 in the continuous reversing mode.
Figure 10:
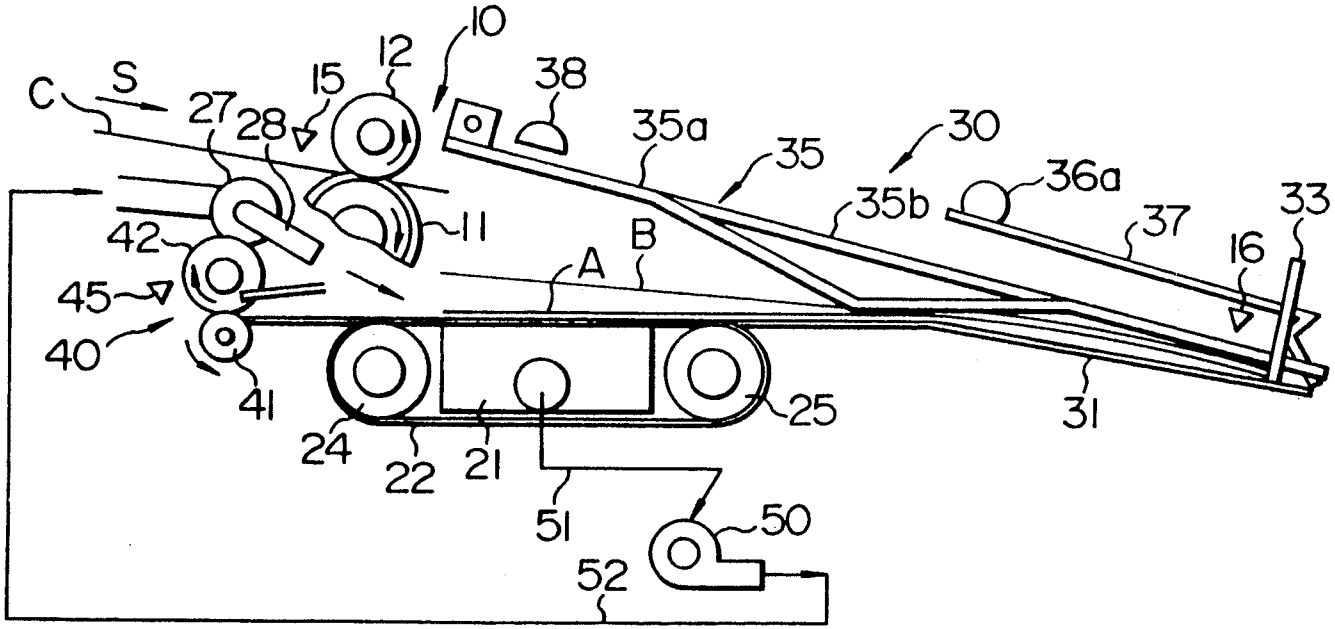
FIG. 10 is a side view for explaining the feeding of a letter-size sheet by the apparatus of FIG. 1 in the stack reversing mode.

Next, the treatment of the sheet having different sizes will be explained with reference to FIGS. 9 and 10. In the illustrated sheet reversing apparatus 1, as shown in FIG. 1, each sheet is fed in its transverse width direction. Accordingly, for example, when a letter size sheet is treated in place of A4 size sheet, since the letter size sheet has a width wider than that of the A4 size sheet by about 6 mm, if the stopper means or stopper plates 37 remain being positioned in the position corresponding to the width of the A4 size sheet, the letter size sheet on the bottom plate 31 will be stopped in a condition that it extends by 6 mm toward the ejecting section, and is attracted to the suction belt 22 at that condition. Thus, in order to accommodate with the letter size sheet, the position of the stopper plates 37 in the continuous reversing mode may be set more upwardly than the case of the A4 size sheet so that the stop position of the sheet is retarded rearwardly by about 6 mm. Further, with respect to the stack reversing mode, as shown in FIG. 10, the stopper plates 37 may be shifted more upwardly than the case of the A4 size sheet to completely clear from the bottom plate 31, and the rear plate 33 may be served as a sheet stopper means. In this way, it is possible to position the letter size sheet in a desired position.

In the sheet reversing apparatus according to the illustrated embodiment, it is possible to perform both continuous reversing of the single sheet one by one and the stack reversing of the plural sheets.

Figure 11:
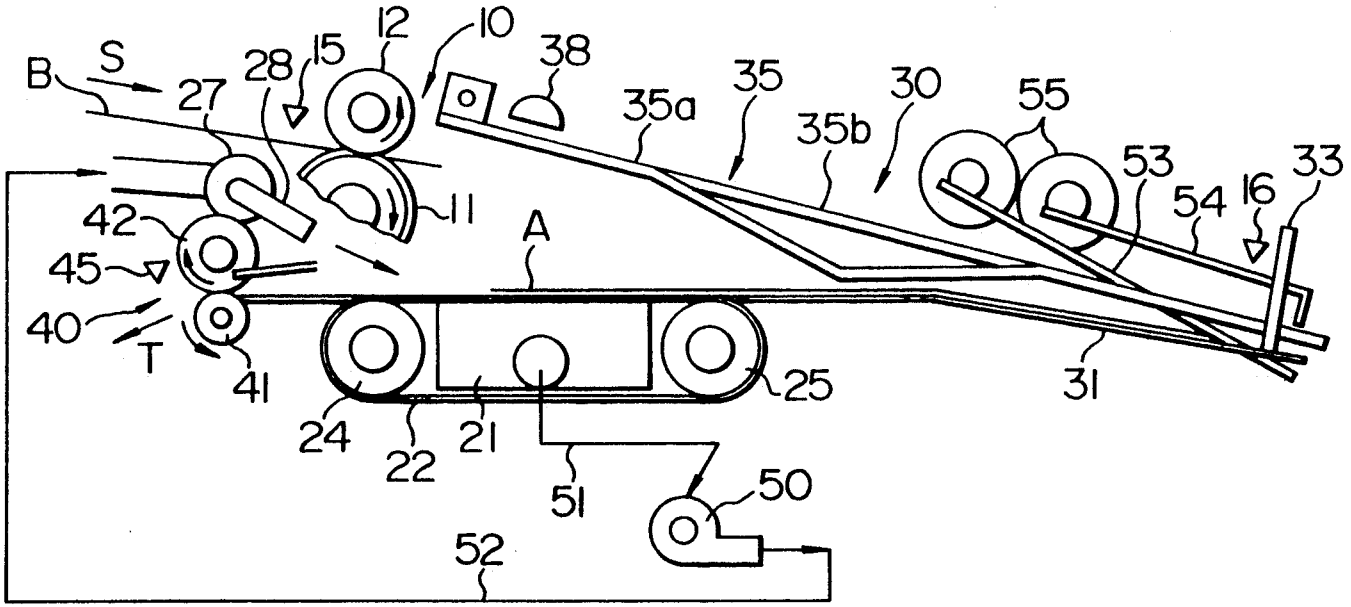
FIG. 11 is a side view for explaining an operation of a sheet reversing apparatus according to a second embodiment in a continuous reversing mode.
Figure 12:
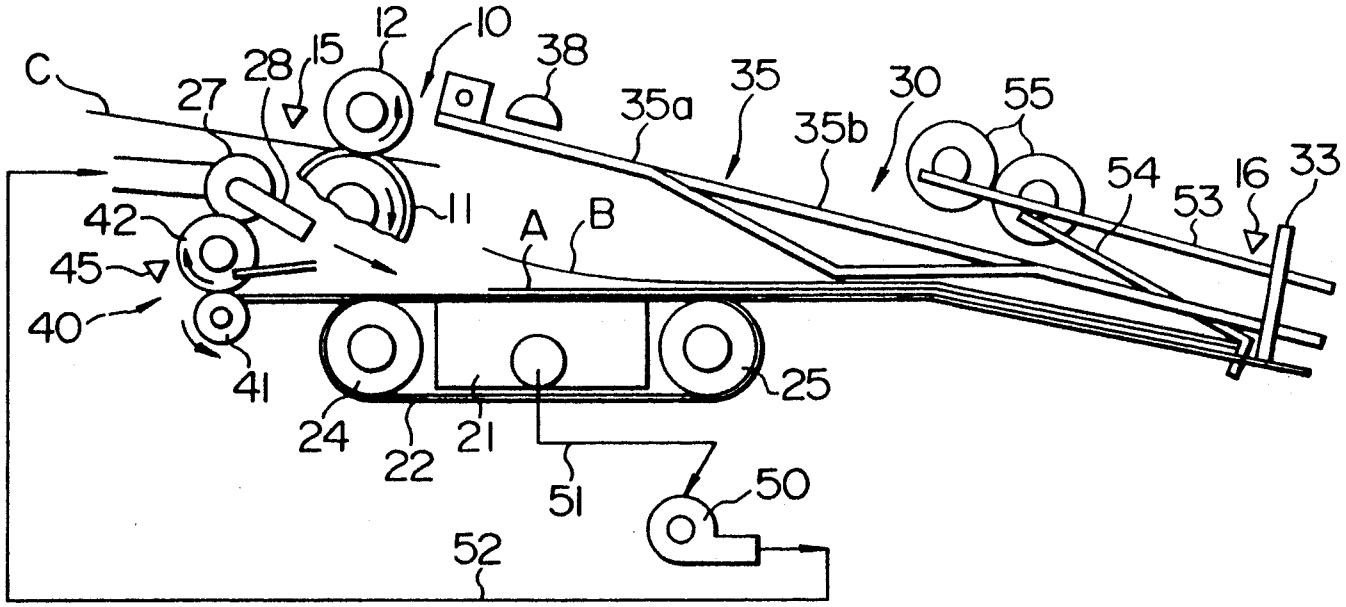
FIG. 12 is a side view for explaining an operation of a sheet reversing apparatus according to the second embodiment in a stack reversing mode.

The sheet reversing apparatus of the second embodiment of FIGS. 11 and 12 is characterized in that two kinds of stopper plates 53, 54 are provided and that these stopper plates 53 and 54 are operatively connected to each other through gears 55. The other arrangement of the second embodiment may be the same as that of the first embodiment, and, thus the same elements are designated by the same reference numerals and the explanation thereof will be omitted.

The stopper plates 53 and 54 are arranged in staggered fashion in a direction perpendicular to a plane of FIG. 11, and are fixedly mounted at their one ends on two shafts disposed adjacent to each other, respectively. A pair of gears 55 are respectively attached to these two shafts and are meshed with each other to rotate in opposite directions.

In operation of the sheet reversing apparatus of the second embodiment, when the A4 size sheet is used, in the continuous reversing mode, the stopper plate 53 is moved to intersect with the bottom plate 31, so that the rebounce of the incoming sheet is suppressed by a gap formed between the stopper plate 53 and the bottom plate 31 as in the case of the first embodiment. In this case, since the other stopper plate 54 is retarded upwardly by the rotation of the gears 55, the introduction of the sheet in the continuous reversing mode is not affected by the other stopper plate.

When the A4 size sheet is used, in the stack reversing mode, when the stopper plate 53 is retracted upwardly for a certain angle, the other stopper plate 54 is powered by the rotation of the gears 55 to intersect the bent end portion of the stopper plate 54 with the bottom plate 31, thereby defined the stop position of the A4 size sheet in the stack reversing mode.

Further, when the letter size or regal size sheet is used, in the continuous reversing mode, the stopper plate 53 is shifted upwardly for a certain angle more than that in the case of the A4 size sheet to increase a length for the sheet to be pinched, thereby determining the stop position of the sheet in response to the increase in the width of the sheet.

On the other hand, in the stack reversing mode, the stopper plate is 53 retracted upwardly for a certain angle less than that in the case of the A4 size sheet, whereby the both stopper plates 53, 54 are separated from the bottom plate 31, thus stopping the sheet by the rear plate 33 acting as the stopper means.

Figure 13:
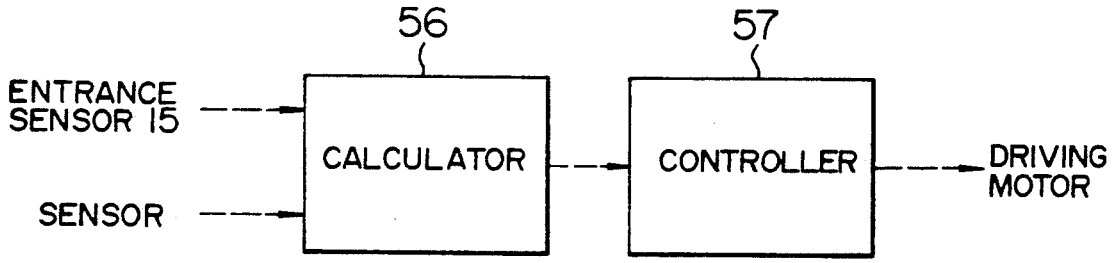
FIG. 13 is a block diagram for explaining a device for determining a length of a sheet.

FIG. 13 is a block diagram showing a detecting means for detecting the size of the sheet. In this example, the entrance sensor 15 or another upstream sensor is connected to an operator 56, where the passing time of the sheet and the sheet size are calculated on the basis of the signal from the sensor and the moving speed of the sheet. The operator or calculator 56 is connected to the driving motor through a controller 57, which activates the motor 36 in accordance with the calculated result, thus determining the swinging angles of the stopper plates.

As mentioned above, according to the present invention, even in the continuous reversing mode or stack reversing mode, the sheet can be abutted against the pivotable guide at different positions to be registered and reversed, thus providing a sheet reversing apparatus having both a continuous reversing function and a stack reversing function.

Further, it is not necessary to provide an additional guide shifting mechanism for various sizes of the sheets, and it is possible to reduce the cost of the apparatus, to prevent the non-feeding and/or double-feeding of the sheets by decreasing the feeding resistance and to improve the reliability of the apparatus.

What is claimed is:

1. A sheet reversing apparatus for feeding out incoming sheets the sheet reversing apparatus comprising a support means on which sheets are stacked, a hold-down guide means for guiding the sheet being fed toward said support means, a stopper means for stopping the sheet to position the sheet on said support means, a feeding means for attracting a lowermost sheet on said support means to feed said lowermost sheet, a blower means for directing an air stream toward a bottom of a sheet stack on said support means to separate said lower most sheet and the remaining sheets, and means for shifting said stopper means to intersect with said support means in a continuous reverse mode to brake and position the sheet by pinching the sheet in a gap defined between said stopper means and said support means and for shifting said stopper means upwardly in a stack reversing mode to position the sheet by a different portion of said stopper means, and wherein said stopper means is pivotable to extend into and retract from a sheet feeding path to said support means so that different positions of said stopper means can abut against the incoming sheet in accordance with said continuous reversing mode wherein the incoming sheet is immediately fed and said stack reversing mode wherein, while the sheets are being stacked, the lowermost sheet is separated and fed.

2. A sheet reversing apparatus according to claim 1, further including a first detecting means for detecting the introduction of the sheet and a second detecting means for detecting the presence of the sheet on said support means; and wherein said stopper means is shifted on the basis of detection signals from said first and second detecting means and a reversing signal for commanding the initiation of the feeding of the sheet.

3. A sheet reversing apparatus according to claim 1, including means for shifting said stopper means by a pivotal angle set in accordance with a size of the sheet.

4. A sheet reversing apparatus according to claim 1, including means for shifting said stopper means by a pivotal angle set in accordance with a size of the sheet determined from an elapsed time before the sheet reaches said support means and a moving speed of the sheet.

5. A sheet reversing apparatus according to claim 2, wherein said stopper means performs the braking of said stack reversing mode if after the introduction of the sheet has been detected by said first detecting means and a predetermined time has elapsed from a generation of said reversing signal, the presence of the sheet has been detected by said second detecting means.

6. A sheet reversing apparatus according to claim 2, including means for determining a size of the sheet on the basis of the detection signal from said first detecting means, and further including means for intersecting said stopper means intersects with said support means at an angle corresponding to the size of the sheet.

7. A sheet reversing apparatus according to claim 2, wherein said stopper means brakes either one of said continuous reversing mode or stack reversing mode depending on whether the detection signal from said first detecting means coincides with the detection signal from said second detecting means or not after the introduction of the sheet has been detected by said first detecting means and a predetermined time has been elapsed from a generation of said reversing signal.

8. A sheet reversing apparatus for individually feeding incoming sheets, the sheet reversing apparatus comprising a support means on which sheets are stacked, a hold-down guide means for guiding the sheet being fed toward said support means, a stopper means for stopping the sheet to position the sheet on said support means, a feeding means for attracting the lowermost sheet on said support means to feed said lowermost sheet, and a blower means for directing an air stream toward a bottom of a sheet stack on said support means to separate said lowermost sheet and the remaining sheets, wherein said stopper means is pivotable to extend into and retract from a sheet feeding path to said support means so that different positions of said stopper means can abut against the incoming sheet in accordance with a continuous reversing mode wherein the incoming sheet is immediately fed and a stack reversing mode wherein, while the sheets are being stacked, the lowermost sheet is separated and fed, and wherein said stopper means includes first and second stopper plates connected to each other to be pivoted in opposite directions, in said continuous reversing mode said first stopper plate intersects with said support means to brake the sheet and said second stopper plate is separated from said support means, and in said stack reversing mode said second stopper plate intersects with said support means to brake the sheet and said first stopper plate is separated from said support means.

9. A sheet reversing apparatus for individually feeding incoming sheets, the sheet reversing apparatus comprising a support means on which sheets are stacked, a hold-down guide means for guiding the sheet being fed toward said support means, a stopper means for stopping the sheet to position the sheet on said support means, a feeding means for attracting the lowermost sheet on said support means to feed said lowermost sheet, and a blower means for directing an air stream toward a bottom of a sheet stack on said support means to separate said lowermost sheet and the remaining sheets, wherein said stopper means is pivotable to extend into and retract from a sheet feeding path to said support means so that different positions of said stopper means can abut against the incoming sheet in accordance with a continuous reversing mode wherein the incoming sheet is immediately fed and a stack reversing mode wherein, while the sheets are being stacked, the lowermost sheet is separated and fed, and wherein said different positions of said stopper means comprise a position cooperating with said support means to pinch the sheet, and a position opposing a leading end of the incoming sheet.

* * * * *